US006482107B1

(12) United States Patent
Urbanski et al.

(10) Patent No.: US 6,482,107 B1
(45) Date of Patent: Nov. 19, 2002

(54) GOLF CLUB HEAD

(76) Inventors: Gary Urbanski, 10 Maplecrest Court R. R. 1, Barrie, Ontario (CA), L4M 4Y8; David Mitchell, 112 Mt. Vernon Rd., Amherst, NY (US) 14226; Mark Myrhum, 4329 E. Melinda La., Pheonix, AZ (US) 85050-8802; Gregory L. Almeter, 296 Main St., Attica, NY (US) 14011

( * ) Notice: Subject to any disclaimer, the term of this patent is extended or adjusted under 35 U.S.C. 154(b) by 42 days.

(21) Appl. No.: 09/597,231

(22) Filed: Jun. 20, 2000

(30) Foreign Application Priority Data

May 19, 2000 (CA) ..... 2308877

(51) Int. Cl.[7] ..... A63B 53/04
(52) U.S. Cl. ..... 473/331; 473/346
(58) Field of Search ..... 473/346, 345, 473/349, 350, 324, 331

(56) References Cited

U.S. PATENT DOCUMENTS 5,277,866 A * 1/1994 Wright
5,595,552 A * 1/1997 Wright
5,706,566 A * 1/1998 Igarashi
5,711,722 A * 1/1998 Miyajima
5,715,887 A 2/1998 Hosokawa ..... 164/97
5,718,641 A * 2/1998 Lin
5,743,812 A 4/1998 Card ..... 473/327
5,873,792 A 2/1999 Chen ..... 473/314
5,984,800 A * 11/1999 Uebelhor
6,007,433 A 12/1999 Helmstetter et al. ..... 473/328
6,010,411 A 1/2000 Reyes ..... 473/345
6,027,416 A 2/2000 Schmidt et al. ..... 473/345
6,033,318 A 3/2000 Drajan, Jr. et al. ..... 473/309

FOREIGN PATENT DOCUMENTS

DE 4034821 A1 * 7/1992

* cited by examiner

*Primary Examiner*—Stephen Blau

(57) ABSTRACT

A golf club head with a body having a ball striking zone with an outer face for contacting a golf ball and an inner face. The body further having a web integral with the inner face of the striking zone to reinforce the striking zone. The integral web having a hub and a plurality of spokes radially extending from the hub. The golf club head is made from a composite resin, formed by injection molding.

16 Claims, 5 Drawing Sheets

GOLF CLUB HEAD

FIELD OF THE INVENTION

The present invention relates to golf club heads. In particular, the present invention relates to a golf club head molded from a composite resin and having an integral web structure.

BACKGROUND OF THE INVENTION

A golf club set generally includes "irons" and "woods". The woods are the clubs that are generally used for longer distance shots. Of the woods, those that are generally used to achieve the longest shots are usually referred to as "drivers".

Golf clubs have a golf club head at one end of a shaft and a grip at the other end of the shaft to allow a player to hold, position and swing the golf club.

Preferably, golf club heads should be manufactured to meet the requirements of a golfer for increased swing, reduced backspin on the ball and increased distance travelled by the ball. In order to fulfill these requirements a golf club head must be manufactured from a material that is strong enough to withstand the impact of the club with a golf ball at varying swing speeds yet also made from a lightweight material that enables a player to easily swing the club.

A golf club head should provide enough force on impact with a golf ball to enable the ball to travel a long distance. In order to provide the force a golf club head must have a particular mass. Golf club wood heads can have a mass in the range of 190–225 g. Typical golf club wood heads have a mass in the range of 200–225 g.

Traditional materials used to make golf clubs include woods, metals and ceramics. The metals that are commonly used include steel, aluminum alloy and titanium. Golf clubs have been traditionally made by casting or forging the golf club head from the material. Since the 1970s hollow metal golf club heads have been manufactured. One manufacturing method utilises a body and an interior mold core. The body is cast around the removable interior mold core and requires an opening within it in order to remove the mold core after casting. Once the interior mold has been removed the opening must be closed which involves attaching, usually by welding, a further piece of the club head over the opening. An alternate method involves the casting of two separate pieces of the head around interior molds, which are subsequently removed after casting. The two pieces are then joined together, usually by welding. Both these methods can be expensive and imperfections in the golf club head can arise from the welding processes.

The majority of clubs are manufactured using a process called "lost wax investment casting". This manufacturing method involves pouring molten metal into a mold to create the club head. Initially a mold has to be created into which the molten metal will be poured. A "brass master" is made using a combination of lathe, electro-etching, filing, sanding and grinding. The "brass master" is then placed in a cavity between two pieces of aluminum or steel to form an enclosed shell. Molten aluminum("hard tooling") or molding resin ("soft tooling") is then poured into the cavity to create a negative image. Once cooled the "brass master" is removed and only used again should another mold need to be created.

The next step in the process involves creating another duplicate of the head using wax injection. Wax is injected into the cavity of the mold to create a wax duplicate. After being checked for defects the wax duplicates are placed on a holder, also known as a "tree". The holder and the heads are then coated in a ceramic slurry mix, and the coating is allowed to dry over time. This process is repeated until the heads have received several ceramic coats. Once dried the ceramic coatings commonly referred to as "shells" are approximately ¼" to ½" thick. The shells are then heated until the wax inside melts and a hollow ceramic shell remains.

The hollow shells are heated to temperatures in the range of 1,000° C. and molten metal, at a temperature in the range of 1,500–1,800° C., is poured into them. Once the metal has cooled, usually 24 hours later, the ceramic is removed from the heads. Initially the heads are repeatedly hit to remove the ceramic and then they are placed in a tumbling machine to remove the final pieces.

After the ceramic has been completely removed a further step is undertaken to grind the connection point ("gate") on the head that held the head to the holder ("tree")so that it is aligned with the contours of the head. The final steps in the process of manufacturing the heads using investment casting are to grind and polish or paint the club heads. Some heads are subsequently foam filled to achieve a greater club head weight, or to dampen any vibration and sound from the head hitting a golf ball, and catch foreign particles such as welding slag, sand, or ceramic.

Various metals can be used in the investment casting process including several types of steel, such as high nickel content steel, stainless steel and maraging steel. Titanium can also be used in investment casting. Titanium has a lighter weight then the alternate metals and has a higher strength to weight ratio however, Titanium casting must be performed in a vacuum environment.

Golf club heads manufactured from materials that are hard such as metals, generally do not easily absorb the energy that is translated through the club head when it hits a ball. This will cause the energy to resonate and travel up the shaft of the club to the golfer. When the club strikes the ball a significant amount of the energy may be lost through ball deformation or compression. Golf club heads manufactured from harder material may cause a higher degree of compression and therefore loss of energy which can decrease the velocity at which the ball leaves the club face and increase the spin on the ball. Golf club heads that are manufactured using traditional casting methods generally have a fixed centre of gravity. The location of the centre of gravity will depend on the density of the material and the size and shape of the golf club head.

Golf club heads have been manufactured incorporating a series of internal ribs within the head to reinforce the club head and minimise any structural changes that occur when the club head strikes a golf ball. The addition of internal structure within the golf club heads has increased the technical requirements for the traditional casting process.

Golf club heads have been manufactured from composite material incorporating one or more layers of a loaded film with a set of plies of pre-preg composite fiber sheet. The pre-preg composite fiber sheet is made by pulling strands of fiber, preferably copper or glass, through a resin film to produce a malleable sheet. The loaded film preferably contains a densifier, such as copper or iron, and/or a weighting agent distributed throughout the film. The golf club head is manufactured applying layers of the loaded film and the pre-preg sheet to a forming mold in a predetermined pattern, depending on the requirements of the club, to create a preform. The preform is then removed from the forming mold and further layers of the plies may be added to the exterior of the mold. The preform is then placed in a curing mold and cured for the required period of time. The structural characteristics of the golf club head, such as the weight and the center of gravity, can be defined by the type, dimensions, location and orientation of the plies in the preform. The majority of woods that are manufactured using this process are constructed from two or more pieces of preform and may require additional plies to be applied to the exterior of the joint areas to enhance the structural integrity of the club head. Metal materials may also be added in areas such as the sole for abrasion resistance and for shaft attachment and to enhance structural integrity.

It Is an object of the present invention to provide a durable lightweight golf club that reduces backspin and absorbs the shock from the ball impact without any structural deformity.

It is also an object of the present invention to provide a method of manufacturing a golf club head from a lightweight durable material that will minimise energy loss and ball compression upon striking a golf ball.

It is a further object of the present invention to provide a structurally rigid golf club made from a composite resin with an integral web design that is stronger than the traditional golf clubs an d allows energy to be transferred back to a golf ball upon contact of the golf club head with the ball.

It is a still further object of the present invention to provide a golf club head of a lightweight and durable material that readily allows for weighting to alter its inherent center of gravity.

SUMMARY OF THE INVENTION

A golf club head wit h a body having a ball striking zone with an outer face for contacting a golf ball and an interface. The body further has a web integral with the inner face of the striking zone to reinforce the striking zone.

The web may have a hub and a plurality of spokes radially extending from the hub. The golf club head is preferably made from a composite resin, formed by injection molding.

The body may have a front portion and a rear portion. The rear portion is joined to the front portion and the ball striking zone is located on the front portion opposite the rear portion.

A method is provided for making a golf club head. According to the method, a body of the club head is injection bolded in a body mold, from a suitable composite resin. The body is ejected from the body mold. Any fill spruce is removed from the body. The body is inserted in a cooling support and quenched.

Additionally, a rear portion of the club head may be injection molded in a rear portion mold, from a suitable composite resin. The rear portion is ejected from the rear portion mold and quenched. The rear portion and the front portion are joined to form the golf club head.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
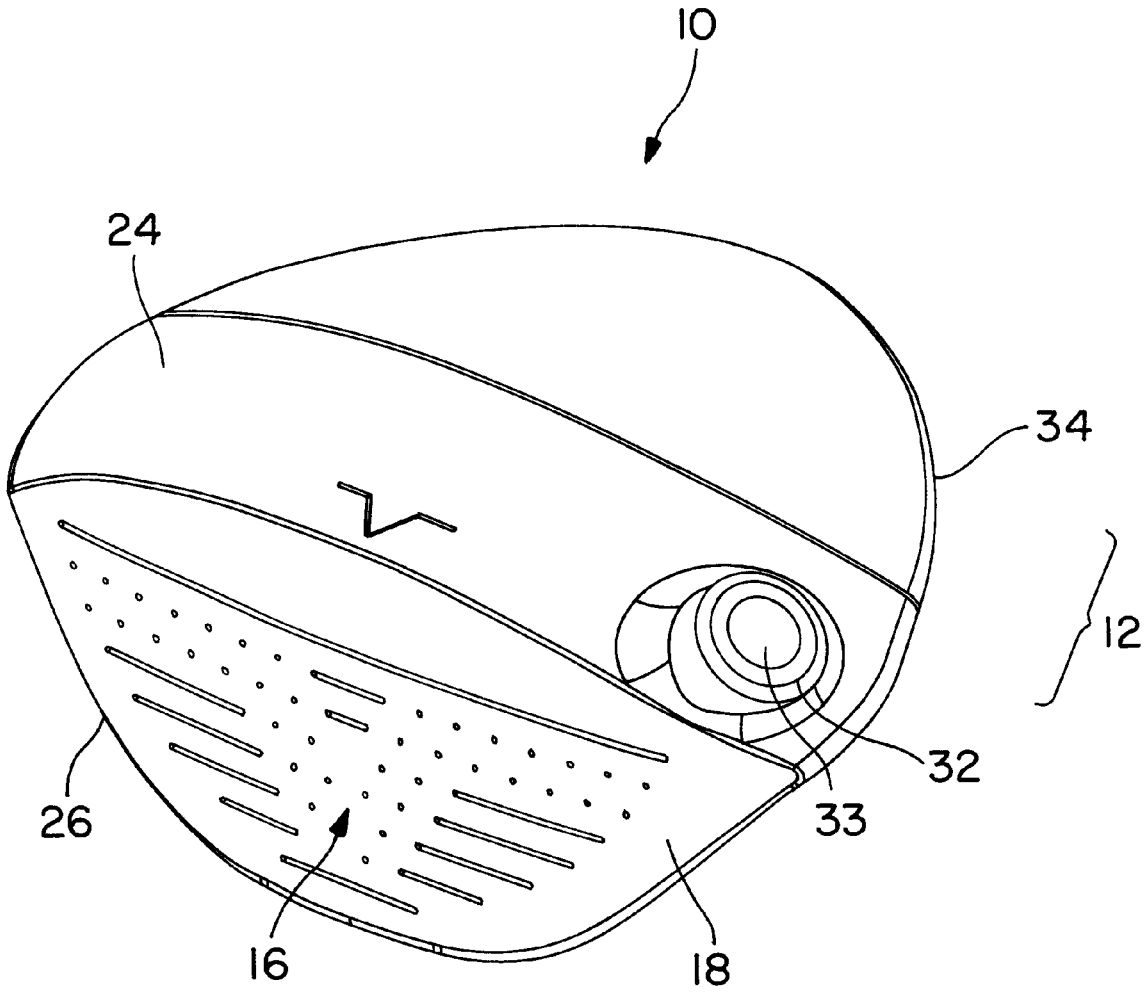
FIG. 1 is an isometric view illustrating a preferred embodiment of a golf club head according to the present invention.
Figure 2:
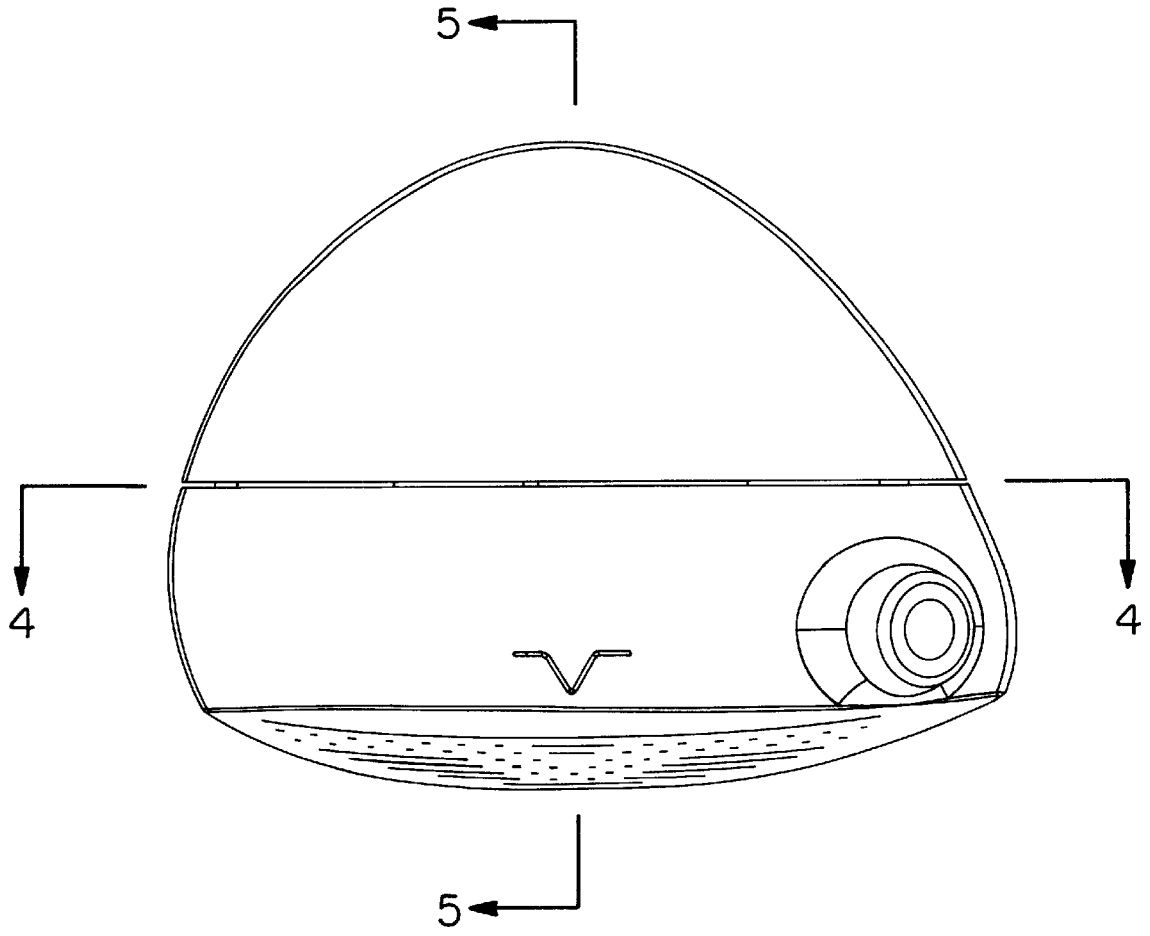
FIG. 2 is a top view of the golf club head in FIG. 1.
Figure 3:
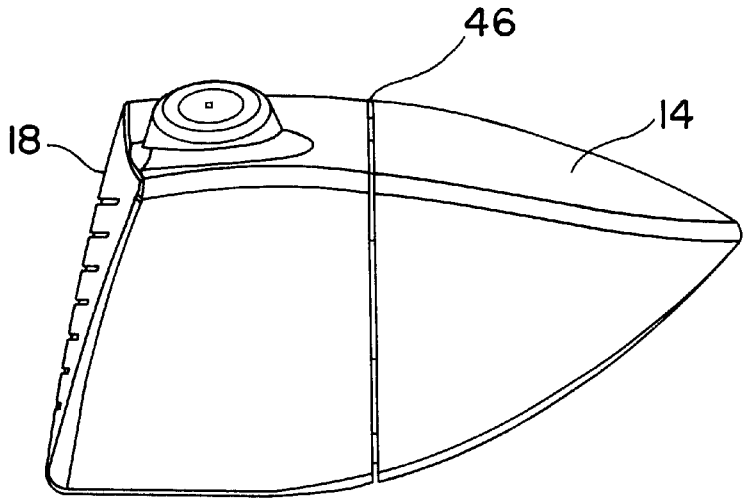
FIG. 3 is a heel view of the golf club head in FIG. 1.
Figure 4:
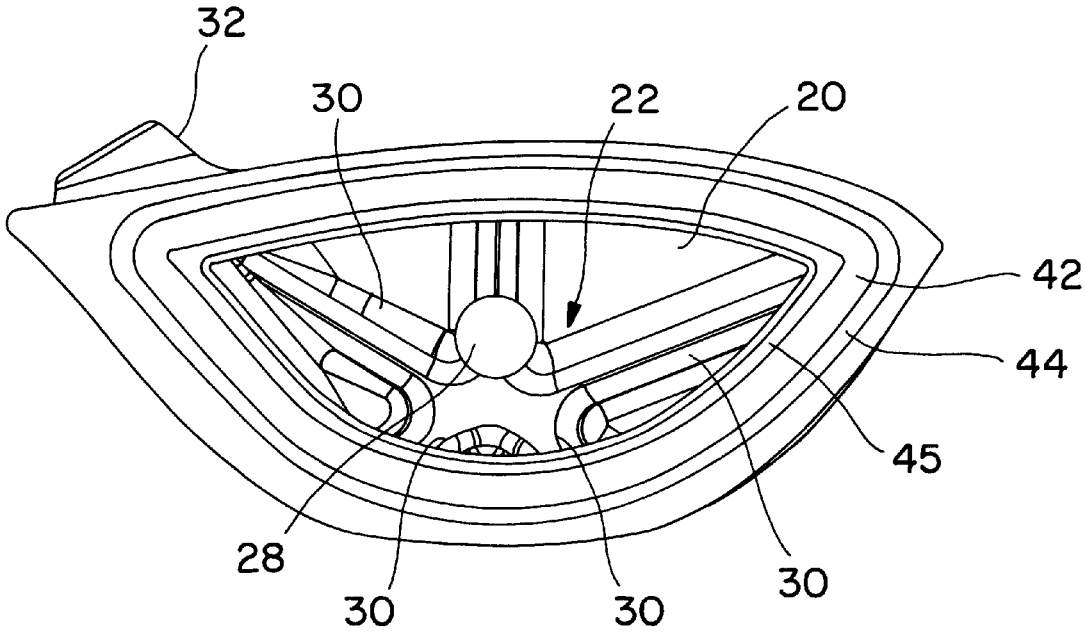
FIG. 4 is a section on line 4–4 of FIG. 2.
Figure 5:
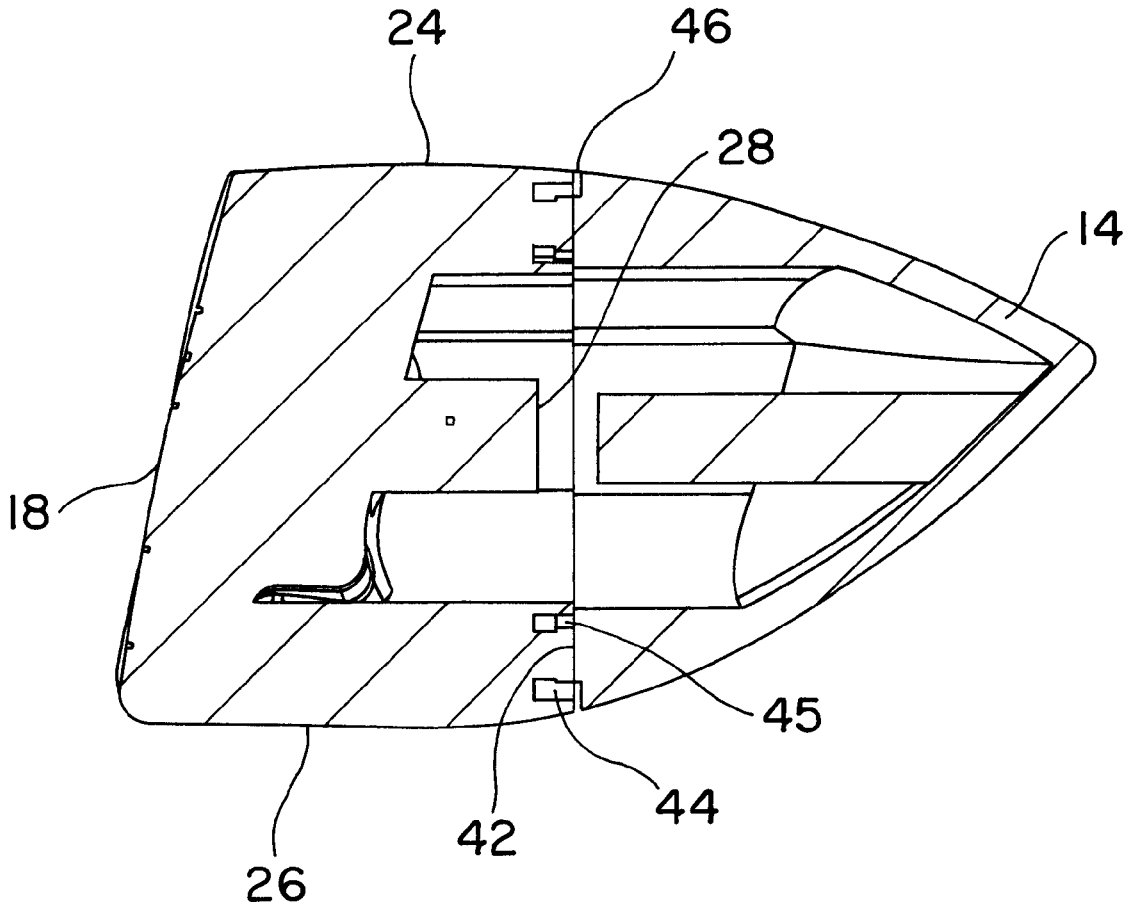
FIG. 5 is a section on line 5–5 of FIG. 2.
Figure 6:
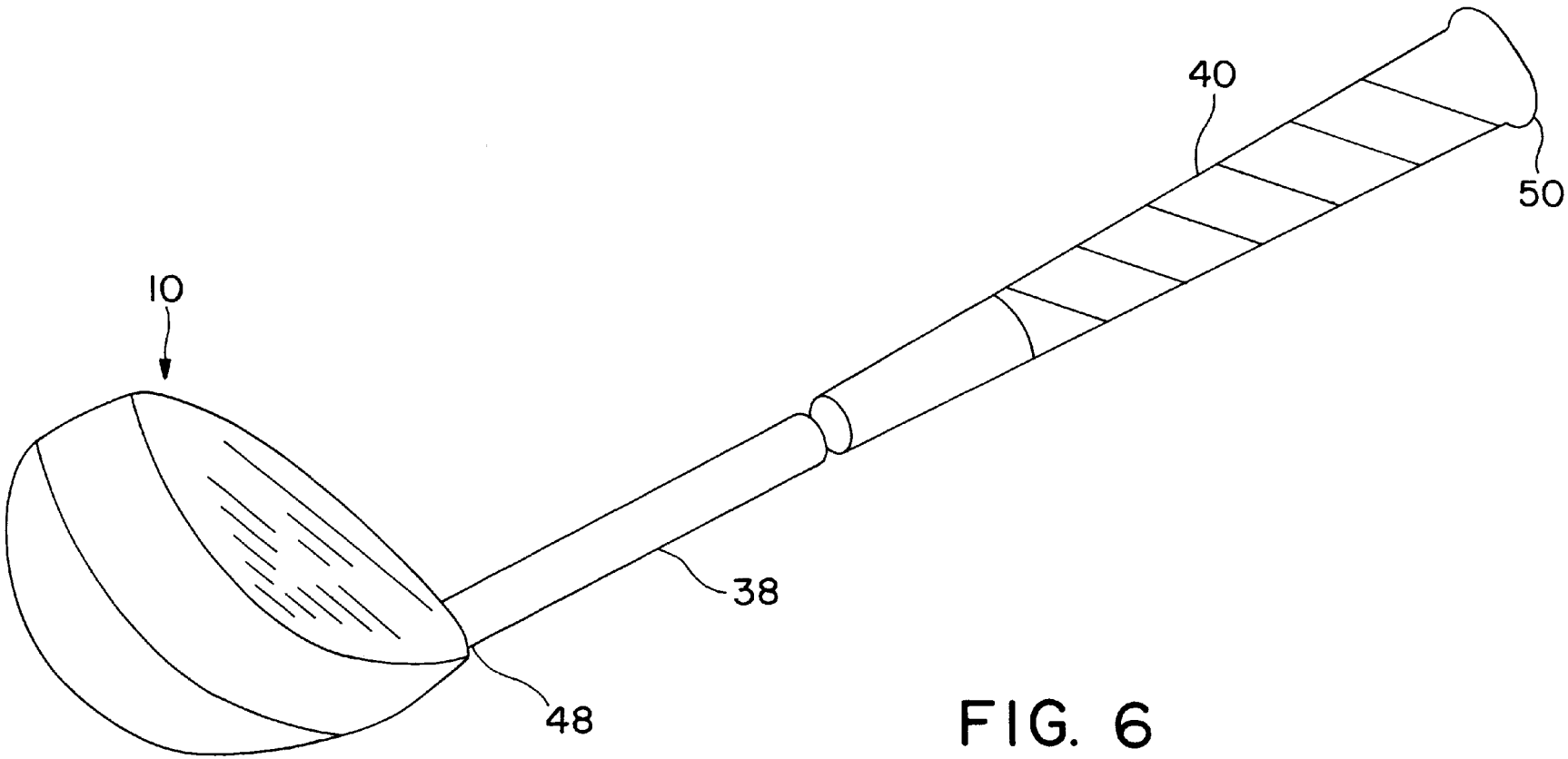
FIG. 6 is an isometric view of a golf club with a head, a shaft and a grip.

According to one aspect of the present invention there is provided a golf club head 10. The golf club head 10 has a body 12. The body 12 has a ball striking zone 16 with an outer face 18 and an inner face 20, located opposite the outer face 18. The body 12 also has a web, generally indicated by reference 22, integral with the inner face 20.

In a presently preferred embodiment the body 12 is substantially clam-shaped and is aerodynamic. The body 12 is made from a nylon polymer in an injection molding process.

The body 12 has a top surface 24 and a bottom surface 26, located opposite the top surface 24. The top surface 24 is substantially arched and the bottom surface 26 is substantially U-shaped and is joined to the top surface 24 at an outer rim 34. The outer face 18 is bulged at a centre point and rolled at the edges that join top surface 24 and bottom surface 26. The outer face 18 may be grooved or smooth.

The web 22 is integral with the inner face 20. The web 22 has a hub 28 and a plurality of spokes 30 extending radially from the hub 28. In a presently preferred embodiment, the hub 28 is located somewhat below the centre point of the inner face 20 in the illustration. The hub 28 may be located at other positions depending on the desired specifications for the location of the centre of gravity in the golf club head.

The golf club head 10 further has a hosel 32 located on the body 12 on the top surface 24 adjacent the outer face 18 and the outer rim 34.The hosel 32 is sized to receive a golf club shaft.

The body 12 may have a rear portion 14. The body 12 is joined to the rear portion 14 along a joining surface 42. In a presently preferred embodiment the body 12 is joined to the rear portion 14 using linear vibration welding. Other suitable methods of joining may also be used such as orbital vibration welding, glue, screws or other mechanical interference fits. The joining surface 42 on the body 12 is separated from the top surface 24 and the bottom surface 26 by a channel 44. The channel 44 prevents any flashing from the joining process reaching the exterior surface of the golf club head 10. The joining surface 42 is adjacent an internal channel 45. The internal channel 45 is located to catch and retain any flash that may become loose within the golf club head 10. The body 12 and the rear portion 14 join along an exterior joining line 46. The joining line 46 may be perpendicular to a preferred line of flight of a golf ball and may act as an alignment aid for aligning the golf club head 10 with a golf ball towards the intended ball flight and target line.

A method for producing the golf club head 10 and a golf club with the golf club head 10 will be described hereinafter. The following ranges have been found suitable, but variations on these ranges may be possible.

The body 12 of the golf club head 10 may be injection molded from a suitable composite resin in a body mold. In a presently preferred embodiment a suitable composite resin is a dried nylon polymer. More preferably a suitable composite resin is manufactured and sold by DuPont under the trademark Zytel 80G33L NC010. Prior to the injection molding, the composite material is dried at a drying temperature in the range of 165° F. to 185° F. for a time in the range of 2 to 5 hours. Preferably the injection pressure of the injection molding machine is in the range of 4,000 psi to 30,000 psi. The front temperature of the injection molding machine is in the range of 500° to 550° F. the middle temperature is in the range of 500° to 580° F. and the rear temperature is in the range of 500° to 600° F. Other ranges of temperatures may also be suitable depending on the injection molding machine and the composite resin used. In a presently preferred embodiment, the mold temperature is in the range of 120° F. to 300° F. Preferably the mold temperature is in the range of 150° F. to 250° F. The nozzle temperature is in the range of 520° F. to 580° F. The suggested maximum moisture percentage is approximately 0.2%, preferably the maximum moisture is less than 0.15%.

The body 12 is ejected from the body mold and any fill sprue located on the body 12 is removed. The body 12 is supported on a cooling support that maintains the structure of the body 12 during the subsequent quenching step.

The body 12 is quenched in a water bath. The water bath is preferably at a temperature in the range of 55° F. to 65° F. In a presently preferred embodiment the body 12 is quenched in the water bath for approximately 10 minutes to 15 minutes, other quenching times may also be suitable depending on the composite resin used.

The rear portion 14 may be injection molded from a suitable composite resin in a rear portion mold. The rear portion 14 may then be ejected from the rear portion mold and quenched in a water bath under similar temperatures for similar times as those described above. Any fill sprue may then be removed from the rear portion 14.

The body 12 may then be joined to the rear portion 14. In a presently preferred embodiment, linear vibration welding is used to join the body 12 to the rear portion 14. Other suitable methods of joining the portions together may also be used, such as orbital vibration welding, glueing, screws or mechanical interference means. The time and pressure for the linear vibration welding is determining by the geometry of the body 12 and the rear portion 14. In a presently preferred embodiment, the linear vibration welding is at a pressure in the range of 35 psi to 60 psi for a time in the range of 5 seconds to 10 seconds.

The thickness of the walls of the body 12 and the rear portion 14 may be varied according to the requirements of the manufacturer and purchaser. The centre of gravity of the golf club head 10 may be changed by decreasing the wall thickness of the body 12 and the rear portion 14 and by adding weight to the internal structure of the golf club head 10.

A method for assembling a golf club will now be discussed. The golf club head 10 is drilled in the centre of the hosel 32 to form the shaft bore 33. The golf club head 10 is placed in a hosel drilling fixture and a hole is drilled. In a presently preferred embodiment the hosel drilling fixture is custom built and the hosel hole is 0.335" in diameter and 1.250" deep. Other methods of forming the shaft bore 33 may also be suitable, such as molding the shaft bore 33 in the golf club head 10 during the injection molding process.

The golf club head 10 is removed from the hosel drilling fixture and the hosel hole is tapped. In a presently preferred embodiment the tap is a ⅜" 16 UNC (or LUNC) bottoming tap, other suitable taps may be used.

A shaft 38 has a tip end 48 and a butt end 50 opposite the tip end 48. The shaft 38 is attached to the hosel 32 at the tip end 48. In a presently preferred embodiment the shaft 38 is attached to the hosel 32 using an adhesive. A currently preferred adhesive is manufactured and sold by 3M under the trademark DP460. Other adhesives may be used that have similar shear values. The shaft 38 and the hosel 32 are left to dry.

The shaft 38 may be cut to a required length that is predetermined based on the specifications of the golf club. A grip 40 is attached to the shaft 38 at the butt end 50. In a presently preferred embodiment the grip 40 is attached to the shaft 38 using two-way tape.

Alternate embodiments to the structure and manufacturing process of the golf club head 10 exist. The body 12 can have more than two portions, for example it could be manufactured from three portions, with a face, a centre piece and a rear piece. Other composite resins may be used that are compatible with the injection molding process and that have the physical properties described above.

The above-described embodiments of the invention are intended in an illustrative rather than a restrictive sense to be examples of the present invention and alterations and modifications may be effected thereto, by those skilled in the relevant arts, without departing from the spirit and scope of the invention which is defined solely by the claims appended hereto.

We claim:

1. A golf club head comprising:

a hollow shell having a ball striking zone with an outer face for contacting a golf ball and an inner surface defining an inner volume;

a cylindrical hub having a longitudinal axis, said cylindrical hub protruding from said inner surface adjacent said ball striking zone, wherein said longitudinal axis is not perpendicular to said outer face;

a plurality of interconnected spokes extending radially from said hub, each said spoke being formed integral to said hollow shell adjacent said ball striking zone; and, a rear portion affixed to said hollow shell to completely enclose said inner volume.

2. A golf club head according to claim 1, wherein the length of said hub along said longitudinal axis is greater than the height of said plurality of spokes.

3. A golf club head according to claim 1, wherein said body is made from a composite resin.

4. A golf club head according to claim 3, wherein said golf club head is molded from said nylon polymer.

5. A golf club head according to claim 4, wherein said nylon polymer is Zytel 80G33L NC010 DAM.

6. A golf club head according to claim 1, wherein said golf club head further includes a hosel.

7. A golf club head according to claim 1, wherein said shell and said rear portion are shaped to reduce aerodynamic drag.

8. A golf club head according to claim 7, wherein said rear portion is joined to said front portion along a joining line.

9. A golf club head according to claim 8 wherein said joining line is visible and acts as an alignment aid for aligning said golf club head with said golf ball.

10. A golf club head according to claim 9, wherein said alignment said is substantially parallel to said outer face.

11. A golf club head according to claim 7, wherein said rear portion is joined to said front portion by linear vibration welding.

12. A golf club head according to claim 7, wherein said web comprises a hub and a plurality of spokes extending radially from said hub along said inner face.

13. A golf club head according to claim 7 wherein said front portion and said rear portion are made from a composite resin.

14. A golf club head according to claim 13 wherein said golf club head is molded from said nylon polymer.

15. A golf club head according to claim 7, wherein said nylon polymer is Zytel 80G33L NC010 DAM.

16. A golf club head according to claim 7, wherein said golf club head further includes a hosel.

* * * * *